US011452905B2

(12) United States Patent
LaFrance, III et al.

(10) Patent No.: US 11,452,905 B2
(45) Date of Patent: Sep. 27, 2022

(54) EXERCISE EQUIPMENT AND METHOD OF USE

(71) Applicants: George H. LaFrance, III, Chinle, AZ (US); Darlene V. LaFrance, Chinle, AZ (US)

(72) Inventors: George H. LaFrance, III, Chinle, AZ (US); Darlene V. LaFrance, Chinle, AZ (US)

( * ) Notice: Subject to any disclaimer, the term of this patent is extended or adjusted under 35 U.S.C. 154(b) by 0 days.

(21) Appl. No.: 16/926,151

(22) Filed: Jul. 10, 2020

(65) Prior Publication Data

US 2021/0023414 A1 Jan. 28, 2021

Related U.S. Application Data

(60) Provisional application No. 62/922,026, filed on Jul. 22, 2019.

(51) Int. Cl.
*A63B 21/00* (2006.01)
*A63B 23/02* (2006.01)
*A63B 21/002* (2006.01)

(52) U.S. Cl.
CPC ..... *A63B 21/4033* (2015.10); *A63B 21/002* (2013.01); *A63B 23/0205* (2013.01); *A63B 2225/093* (2013.01)

(58) Field of Classification Search
CPC . A63B 21/068; A63B 23/04; A63B 21/00047; A63B 21/4035; A63B 23/0405; A63B 2022/0094; A63B 2208/0233; A63B 2225/093; A63B 2225/09; A63B 2210/50; A63B 21/00069; A63B 21/4033; A63B 23/0205; A63B 21/002; A63B 21/00181; A63B 2208/0295; A63B 2209/10; A63B 2210/58; A63B 71/023; A63B 2071/0655; A63B 71/0054; A47C 3/20; A47C 9/002
See application file for complete search history.

(56) References Cited

U.S. PATENT DOCUMENTS 728,684 A * 5/1903 Dieterich ..... D05C 1/02 38/102.21
1,475,442 A * 11/1923 Manger ..... A47D 13/043 482/68
1,923,247 A * 8/1933 Wood ..... A47B 3/12 38/102.4
2,666,640 A * 1/1954 Jennings, Sr. ..... A63B 3/00 482/141

(Continued)

OTHER PUBLICATIONS

Amazon Quilt Stand. https://www.amazon.com/Dritz-3129-Quilters-Floor-Quilt/dp/B001D87YX4/ref=cm_cr_arp_d_product_top?ie=UTF8 (Year: 2013).*

*Primary Examiner* — Garrett K Atkinson
(74) *Attorney, Agent, or Firm* — Aronberg Goldgehn Davis & Garmisa

(57) ABSTRACT

The present system relates generally to a piece of exercise equipment that may be used to assist in the performance of the plank exercise along with a method of using the same. The system includes various embodiments that include horizontal bars with cushions that are supported at one or more vertical heights. A person may rest a portion of their body on the cushions of the horizontal bars so as to alleviate a portion of the weight associated with performing the plank exercise and to help provide balance and stability while performing the exercise.

20 Claims, 4 Drawing Sheets

(56) References Cited

U.S. PATENT DOCUMENTS 2,733,754 A * 2/1956 Leslie et al. ..... A47D 13/043 482/67
2,881,002 A * 4/1959 Chamberlain ..... A63B 9/00 5/103
2,960,701 A * 11/1960 Nawara ..... A63B 21/16 5/503.1
3,189,347 A * 6/1965 Peter ..... A63B 21/0626 482/102
RE26,606 E * 6/1969 Dodge ..... A63B 21/0626 482/130
3,516,425 A * 6/1970 Rigal ..... A61H 3/00 248/157
3,982,754 A * 9/1976 de Moreau ..... A63B 9/00 446/123
4,129,975 A * 12/1978 Gabriel ..... A63H 33/101 D8/382
4,182,511 A * 1/1980 Camp, Jr. ..... A63B 23/0211 601/24
4,274,222 A * 6/1981 Zahn ..... A63H 33/102 52/DIG. 10
4,358,866 A * 11/1982 Rhodes ..... A47C 15/006 441/35
4,415,150 A * 11/1983 Lezza ..... A63B 3/00 248/165
4,474,202 A * 10/1984 Blechner ..... A61H 3/00 135/67
4,638,995 A * 1/1987 Wilson ..... A63B 23/0211 482/142
4,658,521 A * 4/1987 Thorpe ..... D06C 3/08 38/102.6
4,974,620 A * 12/1990 Quillan ..... A61H 3/00 383/7
4,993,446 A * 2/1991 Yarbrough ..... A61H 3/00 135/69
5,120,253 A * 6/1992 Gelardi ..... A63H 33/10 446/77
5,255,697 A * 10/1993 Grauer ..... A61H 3/04 482/66
5,564,786 A * 10/1996 Peek ..... A61G 5/121 280/647
5,632,052 A * 5/1997 Michel ..... A47D 15/008 5/98.1
5,657,783 A * 8/1997 Sisko ..... A61H 3/00 135/73
5,704,682 A * 1/1998 Gorayeb ..... A47C 9/10 297/440.11
5,711,098 A * 1/1998 Warne ..... D06C 3/08 38/102.91
5,800,318 A * 9/1998 Coviello ..... A61H 3/04 482/68
5,842,960 A * 12/1998 Yu ..... A63B 23/0488 482/141
5,862,825 A * 1/1999 Leonard ..... A61H 3/00 280/87.021
6,024,679 A * 2/2000 Castallanos ..... A63B 23/0211 482/142
6,843,695 B1 * 1/2005 Jackson ..... B63B 34/52 441/129
7,357,761 B2 * 4/2008 Mattox ..... A63B 21/0552 482/141
7,431,661 B1 * 10/2008 Cailey ..... A63B 60/52 473/262
7,681,524 B1 * 3/2010 Hudson ..... A01K 1/0107 119/28.5
8,257,088 B1 * 9/2012 Askins ..... A63B 9/00 434/247
8,720,914 B1 * 5/2014 Heath ..... A61H 3/008 280/87.021
9,051,032 B2 * 6/2015 Hanel ..... A47C 15/006
9,272,226 B2 * 3/2016 Samlaska ..... A63H 23/005
9,278,042 B2 * 3/2016 Osterhaus ..... A61H 3/04
9,289,638 B2 * 3/2016 Towley, III ..... A63B 21/00047
9,440,110 B2 * 9/2016 Izzo ..... A63B 23/1236
9,649,523 B2 * 5/2017 Brady ..... A63B 21/068
9,687,693 B2 * 6/2017 Archer ..... A63B 69/0062
10,549,826 B1 * 2/2020 Castro ..... A61H 1/00
10,589,142 B2 * 3/2020 Simpson ..... A63B 21/16
2005/0101461 A1 * 5/2005 Johnson ..... A63B 21/0004 482/141
2006/0267393 A1 * 11/2006 Benites ..... A47C 17/64 297/440.14
2007/0059099 A1 * 3/2007 Anderson ..... B63C 3/06 405/3
2009/0124471 A1 * 5/2009 Storch ..... A63B 23/1209 482/141
2010/0137115 A1 * 6/2010 Storch ..... A63B 23/12 482/141
2014/0357459 A1 * 12/2014 Izzo ..... A63B 23/1236 482/141
2015/0342822 A1 * 12/2015 Osterhaus ..... A61H 3/04 280/657
2016/0089564 A1 * 3/2016 Archer ..... A63B 23/0211 482/140
2016/0158618 A1 * 6/2016 Falzon ..... A63B 69/0079 473/430
2018/0036584 A1 * 2/2018 Kiernan ..... A63B 21/0557
2019/0168062 A1 * 6/2019 Monti ..... A63B 21/00069
2019/0321678 A1 * 10/2019 Domesick ..... A63B 23/12
2020/0009415 A1 * 1/2020 Simpson ..... A63B 21/16

* cited by examiner

EXERCISE EQUIPMENT AND METHOD OF USE

CROSS-REFERENCE

This Application is based on and claims priority to U.S. Provisional Patent Application No. 62/922,026 filed on behalf of George H. LaFrance III and Darlene V. LaFrance on Jul. 22, 2019 which is hereby incorporated herein by this reference in its entirety for all purposes.

BACKGROUND

The "plank" is a common exercise for working on core body muscles. The exercise is generally accomplished by supporting the upper body off the ground on either the hands or elbows/forearms and supporting the lower body off the ground by the toes so that the person's body is suspended horizontal to the ground. In that position, a person must engage core abdominal and back muscles to keep the body in the horizontal position. When those muscles fatigue, the person's knees and hips begin to sag and the effectiveness of the exercise is compromised. Additionally, because the weight of the upper body must be supported by the person's arms, fatigue in the arm muscles, generally the triceps and shoulders, can cause the upper body to sag until failure of the arms results in a loss of the raised horizontal positioning. Again, the effectiveness of the exercise is then lost.

While the plank is a good exercise for targeting core muscles, the drawback of the exercise is that it is fairly advanced and requires significant strength and balance to perform correctly. Thus, beginners, persons that are overweight, persons with impaired balance, and persons that (for whatever reason) do not have four fully functional limbs, often have considerable difficulty performing the exercise with the proper form and for the necessary length of time to effectively train the targeted core muscle groups. Still, with adequate assistance, such individuals are able to perform the exercise, learn the correct technique and posture, and train their muscles while ultimately working up to and performing an unassisted plank. Accordingly, there is a need for exercise equipment that may be used as a plank assistance tool that will help individuals perform the plank exercise in an effective manner and for sufficient lengths of time such that they are able to gain the benefits of the exercise even when they are unable to adequately perform the full, unassisted exercise.

SUMMARY

The present system is directed to a piece exercise equipment and method of use thereof for assisting in performing the plank exercise. The exercise equipment is designed to provide a separated support structure, such as a circumferential platform having a central hole or void that is supported off the ground. The supports may be in the form of legs or panels or a combination thereof. The platform and supports provide stable surfaces of sufficient strength to support the weight of a human body. Different embodiments may be of different structural integrities depending on if they are meant for use by a child versus a full grown, overweight adult or something in-between.

The platform is preferably not a solid platform but rather formed of a plurality of separate bars, in some embodiments forming an annular ring. While the platform may be referred to as a ring, it should be understood that it need not be circular. For example, in one embodiment, the platform is a square ring. In another embodiment, the platform is a rectangular ring. In another embodiment the platform is adjustable. The platform may also include one or more cushions. The cushions may be placed over the structure of the platform. In one embodiment the platform is rectangular and made of four interconnected cross bars or pipes, each of which forms a side. The bars may be substantially horizontal. The cushions, which may be made of a compressible, resilient foam or gel base that may further be covered (such as, for example, with a plastic, vinyl, cloth, or leather cover) may be placed on or around two opposing sides. In one embodiment, cushions are places around all four sides or the majority if not the entirety of the annular ring.

The cushions provide a more comfortable resting spot for the user as well as assisting with balance. Because the cushions are compressible, the user must maintain proper balance to maintain even distribution over the cushion. If balance is not maintained, the cushion will tend to depress more on one side than the other, and the person's body will tilt. That can be used by a personal trainer to identify a weakness or improper form, and the trainer can offer assistance or adjust the posture of the user.

In another embodiment, the cushion on one side is longer than the cushion on the opposing side. A user can place the upper part of their chest on the longer cushion, and the lower cushion contacts the upper abdominals. When the user contracts the abdominals, it raises the user's body off of the platform bar so that it is resting on the abdominal muscle group on top of the cushion. That allows the user to receive tactile feedback by knowing that if they can feel the bar of the platform on one or the other side of the cushion, they are either not contracting their muscles tight enough, or are imbalanced and tilting to one side.

Additional embodiments will be discussed with respect to the accompanying detailed description and drawings.

DETAILED DESCRIPTION OF EMBODIMENTS

Figure 1:
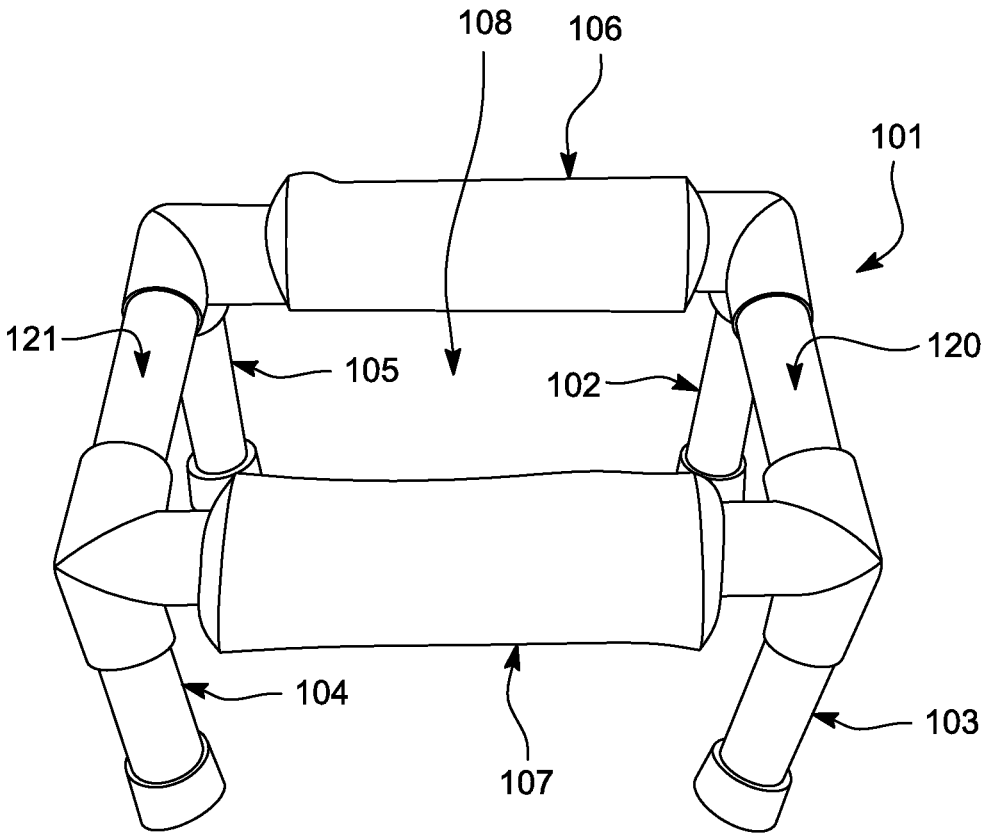
FIG. 1 is a perspective view of an embodiment of an apparatus for assisting in performing the plank exercise.

Throughout the specification, wherever practicable, like structures will be identified by like reference numbers. In some figures, components, such as additional electrical connections or fasteners have been omitted for clarity in the drawings. Unless expressly stated otherwise, the term "or" means "either or both" such that "A or B" includes A alone, B alone, and both A and B together.

FIG. 1 is a depiction of one embodiment of the apparatus for assisting in performing the plank exercise. It includes an annular ring platform 101 and four supports 102, 103, 104, 105. The annular ring platform of the embodiment of FIG. 1 is substantially in the shape of a square, but other shapes could be used. The platform includes a first cushion 106 and a second cushion 107 of substantially the same size and shape. The first cushion and second cushion are spaced apart from each other and generally disposes opposite each other such that there is a void 108 between the first and second cushions. The void allows for one bar to press against the upper sternum and have a secondary support for the lower body while avoiding compression of the soft tissue of the chest which can cause discomfort, particularly for women. In the embodiment of FIG. 1, the annular ring is formed of four bars connected together. Bars 120 and 121 are shown, and the other two bars are substantially the same, but not shown as they are covered by cushions 106 and 107. It should be appreciated that the annular ring could be formed a single unitary piece. For example, one embodiment is a single molded rectangular annular ring, and in such an embodiment, each side may still be considered a separate bar, even though the four sides are seamlessly interconnected.

The cushions are further oriented substantially parallel to each other in the horizontal plane. Generally, the cushions may be wrapped around the bars for ease of manufacturing. For example they may be formed of tubular foam and held in place by a cover having a fastening seam, such as a hook and loop, snap, or zipper seam. However, it is only necessary that the cushions be disposed on the upper surfaces of the bars as the upper surfaces form the contact points with the user. For example, rather than tubular bars, the bars may be flat (or affixed with a flat upper surface) which are then covered in a cushion. The broader flat surface may assist in distributing bodyweight to provide a more comfortable resting position for some individuals. While the embodiment of FIG. 1 depicts the cushions as being the same vertical height (that is, the distance from the bottom of the leg to the uppermost surface of the cushion), it is contemplated that they may be vertically offset such that one is higher than the other. The vertical offset may be achieved by altering the vertical height of one bar supporting one cushion as compared to a second bar supporting a second cushion. In another embodiment, the thickness of the foam of one cushion may be greater than the thickness of the foam of a second cushion. The vertical offset may help facilitate holding the plank position in an inclined state. For example, legs 102 and 105 may be made longer than legs 104 and 103 so as to provide a vertical offset between cushion 106 and 107. In an alternative embodiment, each of the legs are telescopic, as discussed in further detail with respect to FIG. 4. For example, the legs may be made of nesting pipes having a plurality of matching holes. The pipes may be slid in and out of one another and a pin may be slid through the matching holes so as to hold the leg at a set height. The use of legs allows for a user to place their chest on the cushions and grab the legs with their hands for support.

The legs may be irremovably attached to the annular ring. However, in one embodiment, the legs are removable. The four corners of the ring may be formed of multi-point connectors, for example, connector 110 having connection ports 111, 112, and 113. Leg 103 may be inserted and secured into port 113 during use. Leg 103 is adapted to be removable from port 113, and legs 104, 105, 102 are similarly adapted, such that after use, the legs may be removed and the exercise device may be easily transported. Each of the legs may further be equipped with stabilizing feet, such as foot 210 in FIG. 2. It is contemplated that the stabilizing feet may articulate to ensure that the bottom of the foot is able to sit flush to the ground even when one or more legs is oriented at an angle to the ground. It is preferred that the articulation of the feet is such that the legs are not permitted to form an vertical angle of greater than 45 degrees to a horizontal surface so as to keep the center of mass oriented over the feet and preventing the equipment from tipping over under its own weight.

Figure 2:
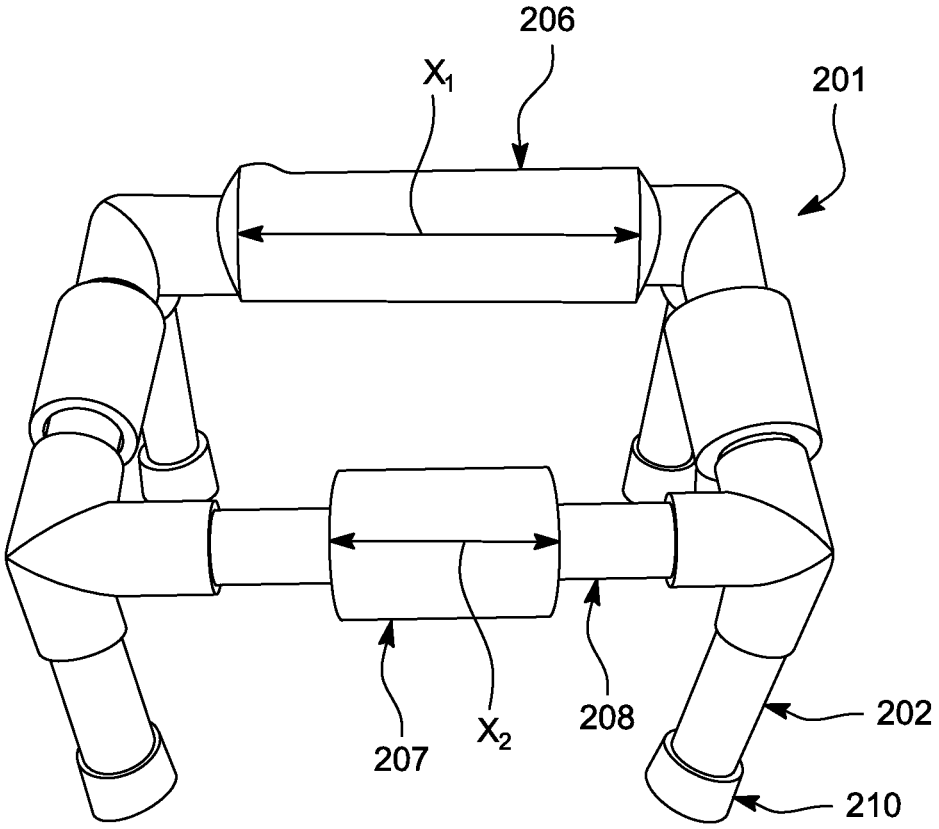
FIG. 2 is a perspective view of an embodiment of an apparatus for assisting in performing the plank exercise.

FIG. 2 is a depiction of an alternative embodiment of the apparatus for assisting in performing the plank exercise. It includes an annular ring platform 201 and at least one support 202. It should be appreciated that the support holds the annular ring platform 201 above the ground in a stable manner. While legs are shown the support could alternatively be a solid panel, or a pedestal connected to a base that provides stability. In such an embodiment, the pedestal may include upper branches that connect to the annular ring so as to maintain the void between the first cushion 206 and the second cushion 207. For example the pedestal may be in the form of a Y or U having branches that connect to the bars 208 and the bar opposite 208 (covered by cushion 206 in FIG. 2 for example) that support the cushions. In such an embodiment the platform may be made of just the two separated bars 208 and the bar opposite 208 (covered by cushion 206 in FIG. 2 for example) rather than a fully formed ring.

In the embodiment of FIG. 2, cushion 206 has a width of $X_1$ while cushion 207 has a width of $X_2$. In the embodiment of FIG. 2, $X_1$ is greater than $X_2$. While not shown in FIG. 2, it is contemplated that cushion 206 and 207 may be vertically offset from one another. Providing an offset where $X_1$ is vertically higher than $X_2$ helps facilitate an angled plank position where the upper chest or sternum can comfortably rest on the larger cushion while the upper abdominals can engage and lift the body away from the bar 208 but still rest and balance on the smaller cushion 207. In the embodiment of FIG. 2, bar 208 extends beyond that edges of the cushion 207. The extension allows for a user to feel the bar if the user begins to tilt to one side and may support the user even when the user tilts rather than allowing the user to fall off the side of a narrow cushion.

Figure 3:
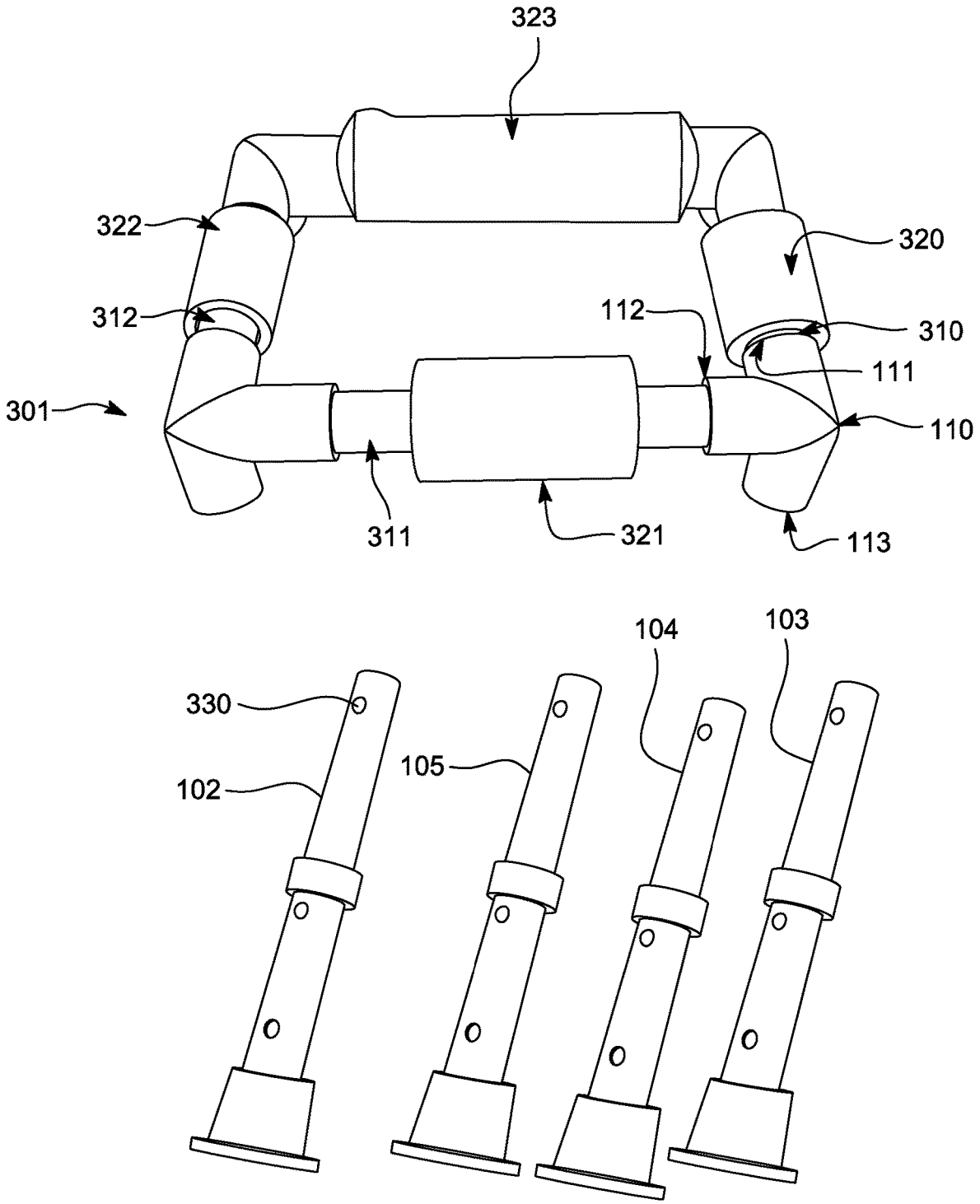
FIG. 3 is a perspective view of an embodiment of an apparatus for assisting in performing the plank exercise in a disassembled state.

FIG. 3 is a depiction of an embodiment of the apparatus in a disassembled state. embodiment includes an annular ring 301 a plurality of bars 310, 311, 312, and the bar covered by cushion 323. Each bar further includes a cushion, 320, 321, 322, 323. Each of the legs, shown in a separated state, may be inserted into one of the multi-point connectors, of which connector 110 is exemplary. In one embodiment the legs frictionally engage the multi-point connectors. However, the connections may be threaded or may include a lock. One example of a lock is a system where a leg includes a resilient pin 330. Resilient pin is adapted to be depressed so that the leg may be inserted into a multi-point connector. Once inserted the resilient pin may engage a detent or hole (not shown) to lock the leg in place. The resilient pin may then be manually depressed to release it from the detent or hole such that the leg may be removed.

Figure 4:
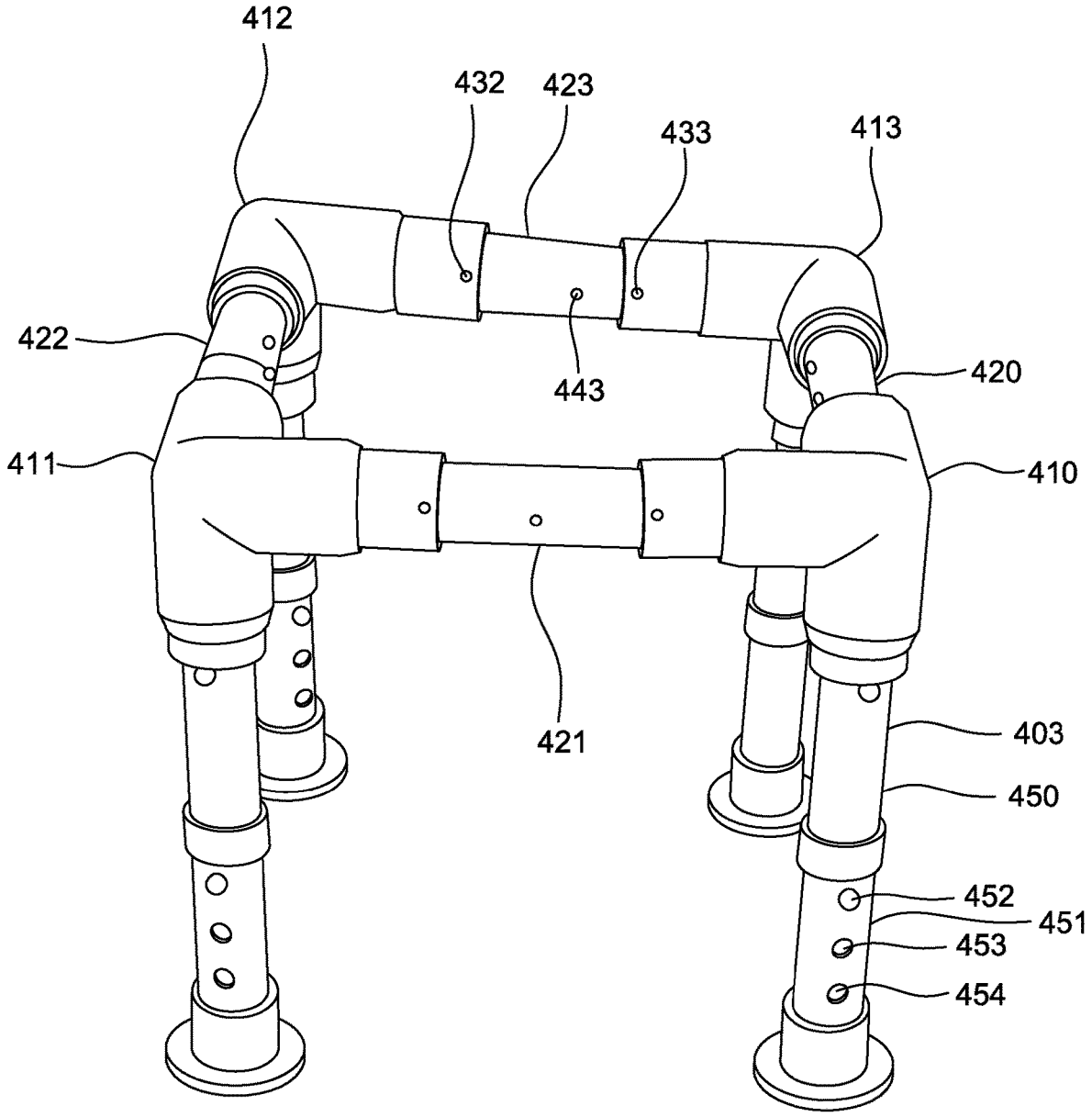
FIG. 4 is a perspective view of an adjustable embodiment of an apparatus for assisting in performing the plank exercise.

FIG. 4 is a depiction of an alternative embodiment. It includes telescopic bars 420, 421, 422, 423. The bars telescope into and out of one or more of the multi-point connectors 410, 411, 412, 413. In one embodiment, bars may lock in place, for example through the use of one or more resilient pins that engage with a mating hole. For example, bar connector 413 may have resilient pin 433 and connector 412 may have resilient pin 432. Bar 423 may include one or more holes, such as hole 443 adapted to engage with one of the resilient pins. It should be appreciated that the other bars and multipoint connectors may be similarly structured. In an alternate embodiment, the bars and connectors are threaded so that screwing and unscrewing the bar brings the connectors closer and further apart, respectively. In such an embodiment the threads of the connectors that are adapted to engage either end of the bar are opposites.

The legs may also be adapted to be telescopic. As shown in FIG. 4, leg 403 includes an upper section 450 and a lower section 451. The sections are configured to telescope, and a lock, such as a resilient pin 452 may be adapted to engage one or more holes 453, 454. As shown in FIG. 4, pin 452 engages with a hole (not shown as it is obscured by being engaged by the pin) to lock the leg at a particular height. It should be appreciated that the embodiment of FIG. 4 may further be provided with cushions as in FIG. 1 or 2.

The method of using the apparatus for assisting with the plank exercise is described below. The embodiments may be used in stages to increase strength and endurance. For example, a beginner may start with the embodiment of FIG. 1. First the embodiment of FIG. 1, which may be referred to as the Plank Helper, may be placed on a substantially flat surface, such as the ground. A user places their upper breast bone on the first cushion 106, their lower torso or abdominals (depending on the height of the person) on the separated cushion 107. The person may also place their toes on the ground as well as their hands or elbows (depending on the heights of the cushions). The person then engages their core muscles to lift their lower body away from the ground while allowing a portion of their upper body to remain supported by one or more of the cushions. The person may also grab legs 105 and 102 with their hands for additional support.

As the user gets stronger, the user may adjust the equipment (such as by utilizing the embodiment of FIG. 4) to provide vertically offset bars. In use, the user raises their abdominals away from the second cushion. When fatigue sets in, the user may rest on both cushions. Alternatively, the user may maintain contact with both cushions at all times and engage their core to focus on training muscles to keep good plank form throughout the legs and hips. The user may further use the embodiment of FIG. 2. Once again the user places their chest on the larger cushion and their abdominals on the smaller cushion. The user engages their core to form the plank position. The user attempts to maintain balance over the smaller cushion while keeping good plank form.

The user may further adjust the positioning of the equipment to enhance the difficulty by placing the upper chest on the cushion 107 in FIG. 1, for example. Used in that manner, the user may rest their chin on cushion 106, but more of the user's bodyweight will be extended from the equipment that when the user positions the upper chest on 106 and the lower chest (or upper abdominals) on 107. That increases the difficulty of the plank exercise while still providing support and stability.

Utilizing one or more of the embodiments, a user is able to train to perform the plank exercise and train the supporting muscle groups over sufficient periods of time to gain the benefits of performing the exercise even when their muscles or balance is not sufficient to perform an unassisted plank. The apparatus allows for staged development and reinforces proper plank form.

Although the present invention has been described in terms of various embodiments, it is to be understood that such disclosure is not intended to be limiting. Various alterations and modifications will be readily apparent to those of skill in the art. Accordingly, it is intended that the appended claims be interpreted as covering all alterations and modifications as fall within the spirit and scope of the invention.

What is claimed is:

1. An apparatus for assisting in performing the plank exercise comprising:

one or more support legs;

at least two substantially horizontal bars each having the same length;

a first compressible, resilient foam or gel cushion disposed on a first one of the at least two substantially horizontal bars;

a second compressible, resilient foam or gel cushion disposed on a second one of the at least two substantially horizontal bars;

wherein the at least two substantially horizontal bars are supported by the one or more support legs such that there is a void between the bar having the first cushion and the bar having the second cushion;

wherein the one or more support legs terminate in a foot connected to the one or more support legs; and wherein the at least two substantially horizontal bars are separated from each other by a distance that is less than the length of the at least two substantially horizontal bars wherein the horizontal bars are configured to assist a user performing plank exercise by supporting the user's torso.

2. The apparatus for assisting in performing the plank exercise of claim 1, wherein the first cushion extends over the majority of an upper surface of the first substantially horizontal bar; and wherein the second cushion extends over the majority of an upper surface of the second substantially horizontal bar.

3. The apparatus for assisting in performing the plank exercise of claim 2 comprising: the first cushion having a first vertical height and the second cushion having a second vertical height, and wherein the first vertical height is greater than the second vertical height; and wherein the first one of the at least two substantially horizontal bars and the second one of the at least two substantially horizontal bars are supported by the one or more support legs at substantially the same vertical height and such that each is substantially parallel in the horizontal plane.

4. The apparatus for assisting in performing the plank exercise of claim 3, wherein the first cushion and the second cushion are substantially parallel in the horizontal plane.

5. The apparatus for assisting in performing the plank exercise of claim 2, wherein the first cushion and the second cushion are positioned at substantially the same vertical height and substantially parallel in the horizontal plane.

6. The apparatus for assisting in performing the plank exercise of claim 2, wherein the one or more support legs comprises four legs;

wherein the at least two substantially horizontal bars comprises four substantially horizontal bars forming a rectangular annular ring such that the annular ring constitutes an uppermost rigid surface of the apparatus;

wherein the rectangular annular ring is supported by the four legs;

wherein each of the four legs terminates in a foot connected to the support leg; and wherein the first cushion and the second cushion are disposed on opposite sides of the annular ring on the at least two substantially horizontal bars that are separated from each other by a distance that is less than the length of the at least two substantially horizontal bars.

7. The apparatus for assisting in performing the plank exercise of claim 1, wherein the first substantially horizontal bar and the second substantially horizontal bar are rigid and substantially parallel;

wherein the first cushion extends over the majority of an upper surface of the first substantially horizontal bar;

wherein the second cushion is smaller than the first cushion such that the second horizontal bar extends from a first edge of the second cushion toward a leg and is exposed at the first edge, and the second horizontal bar extends from a second edge of the second cushion toward a leg and is exposed at the second edge.

8. The apparatus for assisting in performing the plank exercise of claim 7 comprising: the first cushion having a first vertical height and the second cushion having a second vertical height, and wherein the first vertical height is greater than the second vertical height.

9. The apparatus for assisting in performing the plank exercise of claim 8, wherein the first cushion and the second cushion are substantially parallel in the horizontal plane.

10. The apparatus for assisting in performing the plank exercise of claim 7, wherein the first cushion and the second cushion are substantially parallel in the horizontal plane.

11. The apparatus for assisting in performing the plank exercise of claim 7, wherein the one or more support legs comprises four legs;

wherein the at least two substantially horizontal bars comprises four substantially horizontal bars forming a rectangular annular ring such that the annular ring constitutes an uppermost rigid surface of the apparatus;

wherein the rectangular annular ring is supported by the four legs such that one end of each leg is connected to the annular ring and an opposite end of each leg terminates at a foot; and wherein the first cushion and the second cushion are disposed on opposite sides of the annular ring on the at least two substantially horizontal bars that are separated from each other by a distance that is less than the length of the at least two substantially horizontal bars.

12. The apparatus for assisting in performing the plank exercise of claim 7 wherein the second cushion is disposed centrally on the second bar.

13. An apparatus for assisting in performing the plank exercise comprising:

a rectangular annular ring comprising four three-point connectors and four substantially horizontal bars that define a central void such that the annular ring forms the uppermost rigid surface of the apparatus;

four support legs, each support leg having a first end terminating at a foot;

a first compressible, resilient foam or gel cushion disposed on a first one of the substantially horizontal bars;

a second compressible, resilient foam or gel cushion disposed on a second one of the substantially horizontal bars;

each three-point connector including to connection ports oriented in the horizontal plane and one connection port oriented in the vertical plane;

each of the four three-point connectors being engaged with one of the four support legs;

at least two substantially horizontal bars are supported by the one or more support legs;

wherein each of the first one of the substantially horizontal bars and the second one of the substantially horizontal bars is of equal length and is separated from the other by a distance that is less than the length of the first one of the substantially horizontal bars and the second one of the substantially horizontal bars wherein the horizontal bars are configured to assist a user performing plank exercise by supporting the user's torso.

14. The apparatus for assisting in performing the plank exercise of claim 13 wherein, at least two of the threepoint connectors and at least one of the substantially horizontal bars are telescopic.

15. The apparatus for assisting in performing the plank exercise of in claim 14 wherein each of the threepoint connectors and each of the four substantially horizontal bars are telescopic such that a perimeter dimension of the annular ring may be expanded or contracted.

16. The apparatus of claim 15, wherein at least two of the four support legs are telescopic.

17. The apparatus of claim 16, wherein each of the two telescopic support legs is formed of an upper section and a lower section;

each if the two legs includes first lock adapted to mate and lock with one of the multi-point connectors; and each of the two legs includes a second lock adapted to engage and disengage the upper and lower sections of the leg such that the leg is adapted to telescope and be held in a plurality of positions by the second lock.

18. The apparatus of claim 14 wherein the least two of the threepoint connectors and at least one of the substantially horizontal bars include at least one lock.

19. The apparatus of claim 18 wherein the lock comprises a plurality of holes and at least one resilient pin that is adapted to engage with the plurality of holes.

20. A method for performing a plan utilizing an apparatus for assisting in performing the plank exercise, the method comprising:

positioning on a rigid surface an apparatus for performing the plank exercise that includes two bars connected to one another and separated by a void, each bar being substantially parallel to one another in the horizontal plane, each bar having a compressible, resilient cushion, and wherein the first bar has a first vertical height, the second bar is adjacent the first bar and has a second vertical height equal to or greater than the first vertical height;

positioning a body face down over the apparatus;

resting an upper chest portion of the body on the cushion of the first bar;

extending the body over the second bar such that a portion of the abdominal muscles is positioned over the second bar;

resting the body's toes on the rigid support surface separate from the apparatus;

engaging core muscles of the body to maintain a substantially horizontal body posture while resting the body on at least one of the cushions.

* * * * *